US006577750B1

(12) United States Patent
Ohta et al.

(10) Patent No.: US 6,577,750 B1
(45) Date of Patent: Jun. 10, 2003

(54) CLEAN GARMENT MANAGING SYSTEM AIR SHOWER ROOM AND COMPUTER READABLE RECORD MEDIUM

(75) Inventors: Yuuki Ohta, Tokyo (JP); Michio Kuniya, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/434,311

(22) Filed: Nov. 5, 1999

(30) Foreign Application Priority Data

May 25, 1999 (JP) ..... 11-144581

(51) Int. Cl.[7] ..... G06K 9/00

(52) U.S. Cl. ..... 382/111; 414/13; 454/187

(58) Field of Search ..... 382/100, 141, 382/111, 218, 219; 8/115.51; 705/28; 73/38; 55/502; 198/465.4; 356/441, 433; 206/300, 301, 307; 209/523; 68/12.02; 454/187; 414/13

(56) References Cited

U.S. PATENT DOCUMENTS 3,840,103 A * 10/1974 Willis ..... 194/210
4,725,889 A * 2/1988 Yaniv et al. ..... 358/482
5,241,845 A * 9/1993 Ishibashi et al. ..... 68/12.02
5,377,814 A * 1/1995 Smith et al. ..... 198/465.4
5,939,617 A * 8/1999 Lim et al. ..... 73/38
5,997,598 A * 12/1999 Kobayashi et al. ..... 55/502
6,220,687 B1 * 4/2001 Takahashi et al. ..... 347/5

FOREIGN PATENT DOCUMENTS

JP 4-186043 7/1992
JP 7-208784 8/1995

* cited by examiner

*Primary Examiner*—Jayanti K. Patel
(74) *Attorney, Agent, or Firm*—Oblon, Spivak, McClelland, Maier & Neustadt, P.C.

(57) ABSTRACT

A clean garment is provided with inherent identification data. A measuring part measures the cleanliness of the clean garment and outputs the obtained measurement data. An identification data input part reads the identification data of the clean garment and outputs it as an identification data. At least the previous measurement data is stored in a data base in association with the identification data. A signal processing part receives the measurement data and identification data. In the signal processing part, the previous measurement data of the clean garment is read from the data base based on the received identification data C, to calculate the difference (increment) between the now obtained measurement data and the previous measurement data, and the obtained difference is referenced to a predetermined criterion, to judge the cleanliness of the clean garment. The cleanliness of clean garments can be managed per clean garment by a clean garment managing system.

13 Claims, 16 Drawing Sheets

CLEAN GARMENT MANAGING SYSTEM AIR SHOWER ROOM AND COMPUTER READABLE RECORD MEDIUM

BACKGROUND OF THE INVENTION

1. Field of the Invention

The present invention relates to a system or device for managing clean garments workers have on in a clean room which is used as a manufacturing room of semiconductor devices or the like.

2. Description of the Background Art

When the worker enters a clean room with dust adhered to the worker's clean garment, the dust may be carried into the clean room. The dust causes a decrease in the yield of products manufactured in the clean room, for example, semiconductor devices or liquid crystal panels. Therefore the clean garments of the workers entering the clean room are required to be clean. In order to maintain the clean room at a predetermined cleanliness, the worker puts on a clean garment outside of the clean room, for example, in a dressing room, and, before entering the clean room, the dust adhered to the clean garment is removed in an air shower room.

In this regard, Japanese Patent Application Laid-Open No. P04-186043A (1992) discloses one example of the conventional structures of air shower room. Prior art of this publication (hereinafter referred to as "Prior art ①") aims to remove the dust adhered to the clean garments of the workers or the objects carried into a clean room by continuous air blow and ion blow from an ionizer. In an air shower room of Prior art ①, when the worker enters there, the dust removal is performed while measuring the number of dust in the air shower room. When the measured value is below a predetermined standard value, the worker is allowed to enter the clean room.

Japanese Patent Application Laid-Open No. P07-208784A (1995) discloses another example of the conventional structures of clean room. In prior art of this publication (referred to as "Prior art ②"), before the worker enters a clean room, dust and chemical impurity adhered to the clean garment of the worker or the object carried into the clean room are removed in an air shower room and a chemical contamination removing room, thereby preventing the ingress of dust or the like. In the clean room of Prior art ②, when the worker or the like enters the chemical contamination removing room, the concentration of chemical contamination in that room is measured. If the measured value is below a predetermined standard value, the worker or the like is allowed to enter the clean room.

In general, the change of clean garments is merely made at predetermined intervals. At the present time, to decide whether the clean garment of the worker should be changed or not within the predetermined interval often depends on the individual decision. Such a decision is, however, subjective. Even during the work in a clean room, dust or chemical contamination might be adhered to a clean garment. Its amount adhered thereto depends upon factors, such as the size of the clean garment, the working contents of the worker, work environment, and the like. In existing air shower rooms and clean rooms, however, the cleanliness of clean garments is managed by setting a uniform criterion. Therefore, in the present circumstances, management of clean garments fails to consider factors which cause adhesion of dust, etc., and differ from one clean garment to another. Prior art ① and Prior art ② in the Publications merely show techniques of removing dust, etc. and monitoring cleanliness, without separately distinguishing clean garments. Also, both Publications fail to disclose means with which the present circumstances as stated is improved and cleanliness management per clean garment is executable.

In view of the foregoing, it is a first object of the present invention to provide a clean garment managing system with which the cleanliness of clean garments can be managed per clean garment.

It is a second object of the present invention to provide, in addition to the realization of the first object, a clean garment managing system capable of managing the cleanliness of clean garments in consideration of factors which cause adhesion of dust, etc., and differ from one clean garment to another.

It is a third object of the present invention to provide an air shower room capable of realizing the first and/or second object.

It is a fourth object of the present invention to provide a computer readable record medium recording a program with which the processing for realizing the first and/or second object is performed on a computer.

SUMMARY OF THE INVENTION

According to a first aspect of the present invention, a clean garment managing system comprises: an identification data input part that acquires and outputs an identification data identifying a predetermined clean garment; a measuring part that measures a cleanliness of the predetermined clean garment and outputs a measurement data about a measurement result; a data base in which at least a comparison data about the cleanliness of the clean garment is stored in association with the identification data; and a signal processing part that receives the identification data and the measurement data and performs a comparison processing in which a comparison is made between the comparison data in association with the identification data received and the measurement data received.

According to a second aspect, the clean garment managing system of the first aspect is characterized in that the comparison data is the measurement data.

According to a third aspect, the clean garment managing system of the second aspect is characterized in that data about an order in which the measurement data is obtained is stored in association with the measurement data in the data base.

According to a fourth aspect, the clean garment managing system of the first to third aspects is characterized in that the comparison processing is a processing in which a comparison is made between the comparison data in association with the identification data received and the measurement data received, to calculate a difference therebetween.

According to a fifth aspect, the clean garment managing system of the first to fourth aspects is characterized in that the measurement part is at least of a dust counter for measuring the amount of dust in air and an impurity measuring instrument for measuring the concentration of impurity in air.

According to a sixth aspect, the clean garment managing system of the first to fourth aspects is characterized in that the measurement part includes an image capturing device; the measurement data and comparison data include an image data; and the signal processing part performs the comparison processing by image comparison processing.

According to a seventh aspect, the clean garment managing system of the first aspect is characterized in that the measurement part includes an image capturing device; the measurement data includes an entire image data of the predetermined clean garment captured by the image capturing device; the comparison data includes an image data about a clean state of the predetermined clean garment in association with the identification data; and the signal processing part performs the comparison processing by image comparison processing.

According to an eighth aspect, the clean garment managing system of the first to seventh aspects is characterized in that the image processing part further performs judgment processing in which the cleanliness of the predetermined clean garment is judged according to a criterion common to clean garments, based on a result of the comparison processing.

According to a ninth aspect, the clean garment managing system of the first to seventh aspects is characterized in that the data base further stores a reference data in association with the identification data; and the signal processing part further references to the data base to set a criterion based on the reference data in association with the received identification data, to judge the cleanliness of the predetermined clean garment according to the set criterion.

According to a tenth aspect, the clean garment managing system of the first to ninth aspects is characterized in that the identification data is recorded in an ID card carried by a worker wearing the predetermined clean garment.

According to an eleventh aspect, the clean garment managing system of the first to ninth aspects is characterized in that the identification data is recorded on the clean garment.

According to a twelfth aspect, there is provided an air shower room comprising a clean garment managing system in accordance with any one of the first to eleventh aspects.

According to a thirteenth aspect, there is provided a computer readable record medium recording a program which is used in computer management of a cleanliness of clean garments by employing an identification data input part that acquires and outputs an identification data identifying a predetermined clean garment, a measuring part that measures the cleanliness of the clean garment and outputs a measurement data about its measurement result, and a data base in which at least a comparison data of the cleanliness of the clean garment is stored in association with the identification data. The computer readable record medium records the program with which the computer executes the steps of: (a) acquiring the identification data from the identification data input part; (b) acquiring the measurement data from the measuring part; and (c) referencing the data base for making a comparison between the comparison data in association with the identification data acquired and the measurement data acquired.

In the first aspect, the identification data and a predetermined clean garment are associated with each other, and an identification data and a comparison data are associated with each other. Thereby, the measurement data of the cleanliness of the predetermined clean garment and the comparison data are associated with each other via the identification data. Therefore, the comparison processing in the signal processing part can be performed per clean garment. With the comparison result, the cleanliness of clean garments can be managed per clean garment.

In the second aspect, since comparison data is measurement data, by storing (at least) the previous measurement data in a data base, the signal processing part can reference to the data base to compare the now obtained measurement data and the previous data.

In the third aspect, measurement data and the data about the order they are measured are stored in a data base. By referencing to the data base, it is therefore possible to obtain, for example, information about a comparison between the now obtained measurement data and the past measurement data, or the history of the cleanliness of a predetermined clean garment.

In the fourth aspect, the signal processing part calculates the difference between the now obtained measurement data and the previous measurement data at the comparison processing. Therefore, even when judgement of cleanliness is made according to a common (uniform) criterion for all the clean garments, by using a relative value, namely, the difference, judgement is made upon canceling the base quantity of cleanliness which can differ from one clean garment to another.

In the fifth aspect, any one of the effects in the first to fourth aspects is obtainable.

In the sixth aspect, upon acquiring the measurement data as the discoloration of a clean garment, any one of effects in the first to fourth aspects is obtainable.

In the seventh aspect, since measurement data is the entire image data of a predetermined clean garment captured by the image capturing device serving as a measuring part, the measurement data contains information about the size of the clean garment. This permits cleanliness management per clean garment, taking its size into consideration. In addition, since comparison data is data associated with a predetermined clean garment, the degree in which the cleanliness is reduced from a clean state is obtainable by performing comparison processing per clean garment.

In the eighth aspect, any one of the effects in the first to seventh aspects is obtained, besides, judgement of the cleanliness of a clean garment can be performed.

In the ninth aspect, the signal processing part sets a judgment criterion based on a reference data associated with the received identification data, and then performs judgement of the cleanliness of a clean garment. At this time, by using, as the reference data, data about the size of the clean garment, the work contents of the worker wearing the clean garment, work environment, etc., judgment processing of the cleanliness of the clean garment can be made taking such information into consideration. This permits a further detailed management per clean garment.

In the tenth aspect, the ID card carried by the worker can be directly utilized in the clean garment managing system.

In the eleventh aspect, since the identification data is recorded on a clean garment, it is possible to make certain of the association between the clean garment and the identification data.

In the twelfth aspect, it is able to provide an air shower room with which any one of the effects in the first to eleventh aspects is offered and the cleanliness of a clean room is improved.

In the thirteenth aspect, cleanliness management of clean garments is performed on a computer, and the same effect as in the first aspect is obtained.

These and other objects, features, aspects and advantages of the present invention will become more apparent from the following detailed description of the present invention when taken in conjunction with the accompanying drawings.

DESCRIPTION OF THE PREFERRED EMBODIMENTS

1. First Preferred Embodiment

A. Construction of Clean Garment Managing System

Figure 1:
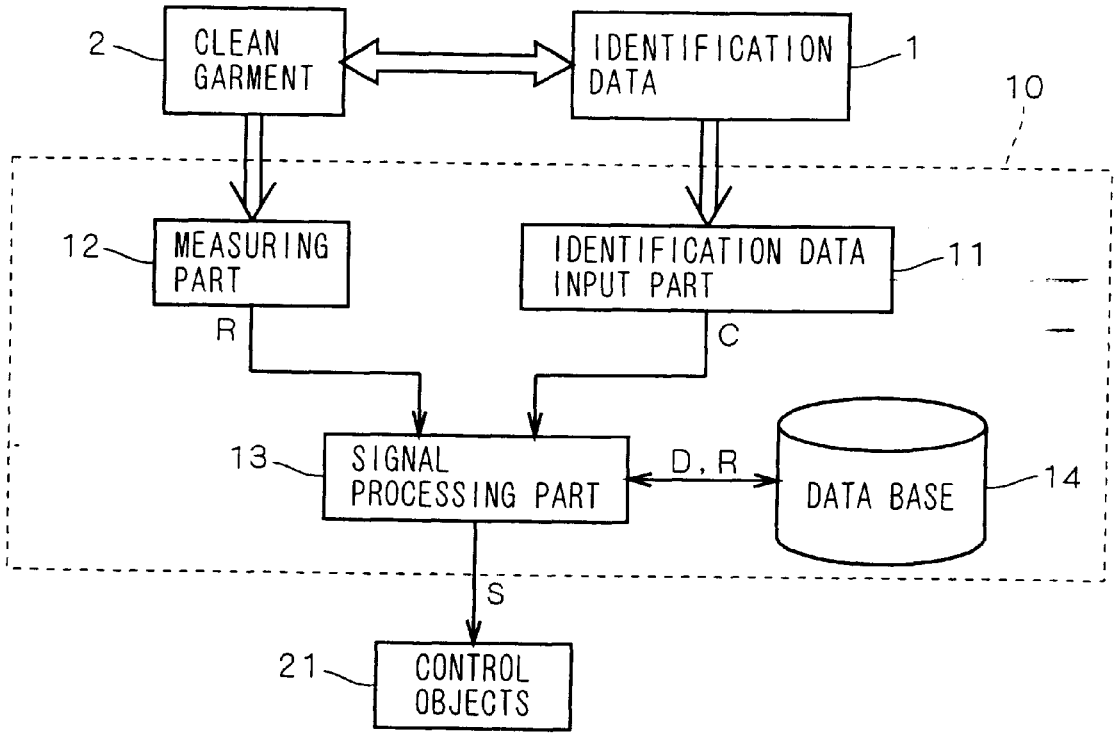
FIG. 1 is a schematic block diagram depicting a clean garment managing system in accordance with the present invention.

FIG. 1 shows a schematic block diagram illustrating a clean garment managing system (or device) 10 constructed in accordance with the present invention. For operation of the clean garment managing system 10, each clean garment 2 is provided with the inherent identification data 1 for identifying the clean garment, as shown in FIG. 1.

Referring to FIG. 1, the clean garment managing system 10 comprises (a) a measuring part 12 which measures the cleanliness of the clean garment 2 as a measuring object, and outputs a measurement data R about the measurement result; (b) an identification data input part 11 which acquires the identification data 1 identifying the clean garment 2 and outputs it as an identification data C receivable by a signal processing part 13 described below; (c) the signal processing part 13 which receives the measurement data R and identification data C and performs a predetermined processing described below in detail, based on both data R and C; and (d) a data base 14 which stores a comparison data D about the cleanliness of the clean garment and allows the signal processing part 13 to perform read/write operation. For instance, a signal processor, e.g., a microcomputer, is suitably used as the signal processing part 13. In this case, the signal processing part 13 can perform read/write operation to the data base 14 by storing the data base 14 in a device to which the microcomputer is accessible, for example, a memory or hard disk.

Figure 2:
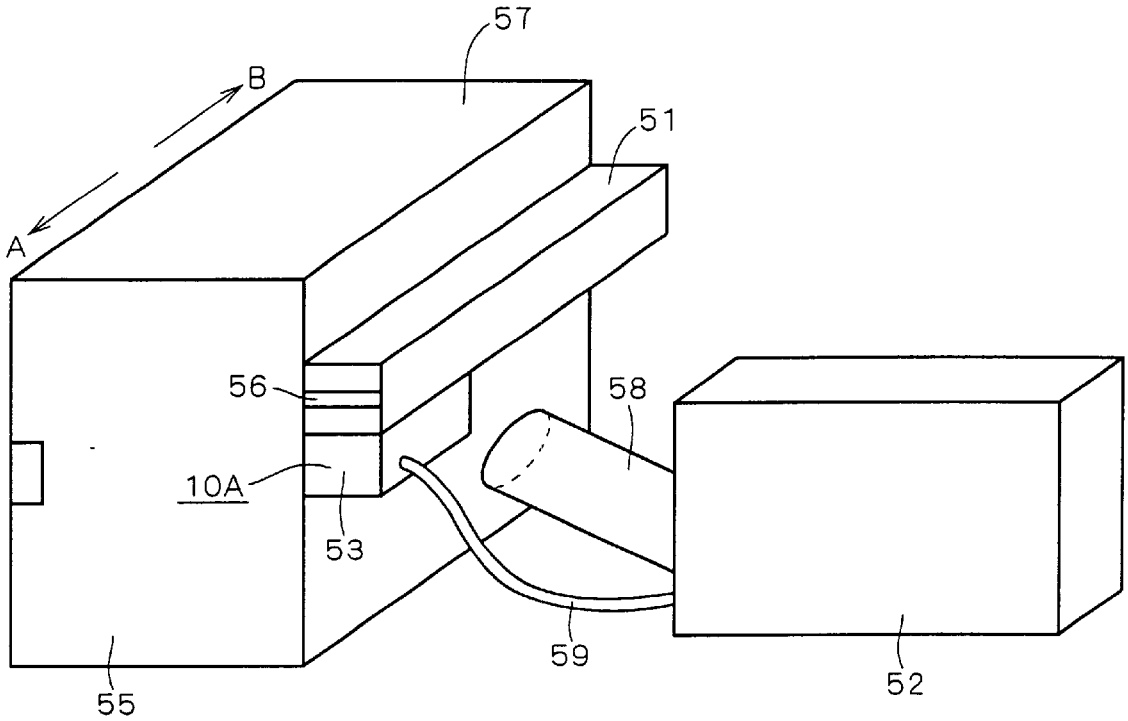
FIG. 2 is a schematic diagram depicting a clean garment managing system in accordance with a first preferred embodiment.
Figure 2:
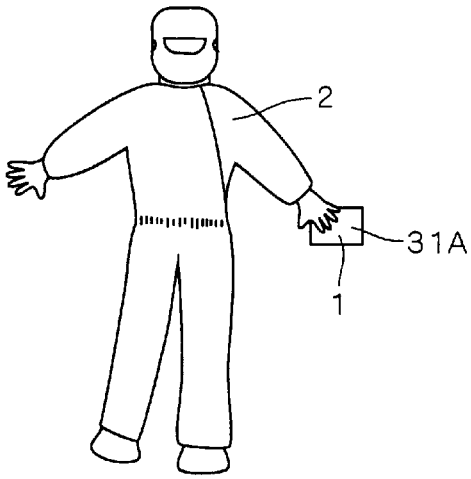

A specific example of the construction of the clean garment managing system 10 will be described by referring to FIG. 2, showing a schematic block diagram of a clean garment managing system 10A. As shown in FIG. 2, the clean garment managing system 10A coexists with an air shower room 57 disposed between a dressing room where the worker puts on a clean garment 2 (the side shown by the arrow A in FIG. 2) and a clean room (the side shown by the arrow B in FIG. 2). A partition between the dressing room and clean room, etc. are omitted in FIG. 2 for sake of simplicity.

For operation of the clean garment managing system 10A, the clean garment 2 is provided with an ID card 31A inherent in each clean garment. In the ID card 31A there is stored an identification data 1 that is information for specifying the clean garment 2 to which the ID card 31A belongs. When a predetermined worker puts on a predetermined clean garment 2, the ID card provided in advance for specifying the worker may be utilized as the ID card 31A.

As a method of recording the identification data 1 in the ID card 31A, there are, for example, magnetic recording, optical recording such as hologram, and recording by means of printing a variety of graphics such as characters, numerics, symbols, and bar codes. Further, the identification data 1 may be recorded in an IC memory within a so called IC card (of contact/contactless type). Alternatively, by putting a punch hole or notch in the ID card 31A, the identification data 1 may be recorded as the shape of the card.

Upon this, the clean garment managing system 10A has, as an identification data input part 11, an ID card reader (hereinafter called merely "card reader" in some cases) 51 that can read the identification data 1 recorded in the ID card 31A.

In addition, the clean garment managing system 10A has a dust counter 52, as a measuring part 12. In the clean garment managing system 10A, the signal processing part 13 and data base 14 as shown in FIG. 1 are disposed within a unit 53, and the unit 53 and card reader 51 are disposed adjacent each other, so that both bodies are integrally formed. Therefore, a data transfer path from the components 13, 14 and the card reader 51 to the signal processing part 13 is not illustrated in FIG. 2. The dust counter 52 absorbs, through a duct 58, air in the air shower room 57 to measure the amount of the dust present therein. Its measurement result is then transmitted to the signal processing part 13 (see FIG. 1) in the unit 53 via a data transfer cable 9. Here, the term "dust" is understood to mean a material that is measurable as a solid.

B. Operation of Clean Garment Managing System

Referring to the flowchart of FIG. 3 in addition to FIGS. 1 and 2, operations of a clean garment managing system 10A until the worker enters a clean room will be described in sequential order.

Firstly, the worker wearing a clean garment 2 inserts an ID card 31A into a card insertion slot 56 of a card reader 51, and opens a door 55 on the dressing room side to enter an air shower room 57. At this time, the card reader 51 reads the identification data 1 stored in the inserted ID card 31A and transmits an identification data C as the results of reading, to a signal processing part 13 (step ST1). The signal processing part 13 then accesses a data base 14 to read or acquire a comparison data D (step ST2). In the data base 14 of the first preferred embodiment, the measurement data R, particularly at least the previous measurement data R, measured and outputted by a dust counter 52 is stored in association with the identification data C. Note that step ST2 may be completed before step ST4 described below is started.

At the moment the worker enters the air shower room 57, air is blown against the clean garment 2 or the worker for a predetermined time. After a waiting time of several seconds, for example, has elapsed on completion of the air blow, the dust counter 52 measures the amount of dust in the air shower room 57 for a predetermined time, and transmits the measured dust amount as a measurement data R, to the signal processing part 13 (step ST3). In this manner, the clean garment managing system 10A acquires the cleanliness of the clean garment 2 based on the measured dust amount.

The signal processing part 13 compares the received measurement data R with the read measurement data R (or the comparison data D), to calculate a difference or increment (step ST4). Then, the signal processing part 13 judges whether the calculated dust increment is within a predetermined range of criterion (step ST5) and, based on the judgement result, outputs a predetermined control signal S to a variety of control objects 21 described below (step ST6).

When the signal processing part 13 judges the increment is in the range of the criterion at step ST5, the signal processing part 13 outputs a control signal S of the judgement result to the card reader 51 (step ST6). Upon receipt of the control signal S, the card reader 51 sends the ID card 31A to a card discharge slot (not shown in FIG. 2) on the clean room side (step ST7). The control signal S is also outputted to a control part of a lock mechanism (not shown in FIG. 2) disposed in the door (not shown in FIG. 2) on the clean room side in the air shower room 57, thereby releasing the lock of the door. A transfer path through which the control signal S is transferred from the signal processing part 13 to the control part of the lock mechanism of the door is not illustrated in FIG. 2. The worker enters the clean room and takes the ID card 31A from the card discharge slot of the card reader 51, and the worker carries the ID card 31A.

On the other hand, when the signal processing part 13 judges the increment does not fall within the range of the criterion at step ST5, the signal processing part 13 outputs a control signal S of the judgement result to the card reader 51. Upon receipt of the control signal S, the card reader 51 sends the ID card 31A to the card insertion slot 56 on the dressing room side (step ST7). The control signal S is also outputted to the control part of the lock mechanism of the door. Upon receipt of the control signal S, the control part locks the door on the clean room side in the air shower room 57, so that the worker is not allowed to enter the clean room. The worker then returns to the dressing room, and takes the ID card 31A from the card insertion slot 56. The worker carries the ID card 31A and proceeds to change the clean garment 2, or the like.

Alternatively, it is possible to inform whether the worker is allowed to enter the clean room or not, by disposing a warning light, display device, etc. in the air shower room and controlling its lighting or display operation by using the control signal S.

The signal processing part 13 associates the now obtained measurement data R with the identification data C received at step ST1, and stores (or updates) it (as a comparison data D) in the data base 14 (step ST8). Note that step ST8 may be executed at any time after the point of time at which the signal processing part 13 receives the now obtained measurement data R.

Thus, in accordance with the clean garment managing system 10A, the identification data 1 (or identification data C) and a predetermined clean garment 2 are associated with each other, and the identification data C (or identification data 1) and the comparison data D (or measurement data R) are associated with each other. Thereby, the measurement data R of the cleanliness of a predetermined clean garment 2 and the comparison data D are associated with each other via the identification data C. Therefore, the comparison processing at step ST4 is executable per clean garment in the signal processing part 13. The use of the comparison result permits cleanliness management per clean garment 2.

Specifically, the signal processing part 13 calculates, the difference between the now obtained measurement data R and the previous measurement data R at step ST4. Therefore, even when cleanliness judgement is made based on a common (uniform) criterion for all the clean garments, by using a relative value, namely, the difference, the judgement step ST5 is executable by canceling a base quantity of cleanliness which can differ from one clean garment 2 to another, due to the size of the clean garment 2, the work contents of the worker wearing the clean garment 2, work environment (cleanliness level), and the like. In addition, the difference may be used to detect at step ST5 unstationary or non-routine events such as an abrupt increase in dust amount and a defect of a clean garment. From the point of view of managing the unstationary events, there may be utilized the past measurement data R, e.g., the measurement data R of two times before, as a comparison data D. In the case where the past measurement data R are stored together with the order measured (e.g., date, the number indicating the order measured, etc.) such as to be associated with each other, the unstationary events may be managed by using the history of the difference (dust amount), including the now obtained measurement data R.

When judgement according to the criterion set per clean garment is made by using, as the criterion, the data about the size of a clean garment 2, the work contents of the worker wearing the clean garment 2, or work environment, it is able to perform a further detailed management per clean garment. For instance, the data of the clean garment size may be associated with the identification data C and stored it as "reference data" in the data base 14, thereby adding step ST2A to the flowchart of FIG. 3, as shown by the flowchart of FIG. 4. Specifically, at step ST2A, the signal processing part 13 reads the reference data associated with the identification data C received at step ST1, and sets a criterion based on the reference data. The signal processing part 13 then performs judgement processing at step ST5, based on the criterion. Step ST2A may be executed before step ST5. Other steps are the same as those in FIG. 3, therefore, in FIG. 4 the same reference numerals have been retained for similar parts for reference to their description. This is true for the following description.

As stated above, the clean garment managing system 10A (10) or the air shower room having the system 10A (10) enables to maintain the cleanliness of the clean room at a predetermined level. This realizes a high yield of products manufactured in the clean room, such as semiconductor devices.

1.1 First Modification of First Preferred Embodiment

Figure 5:
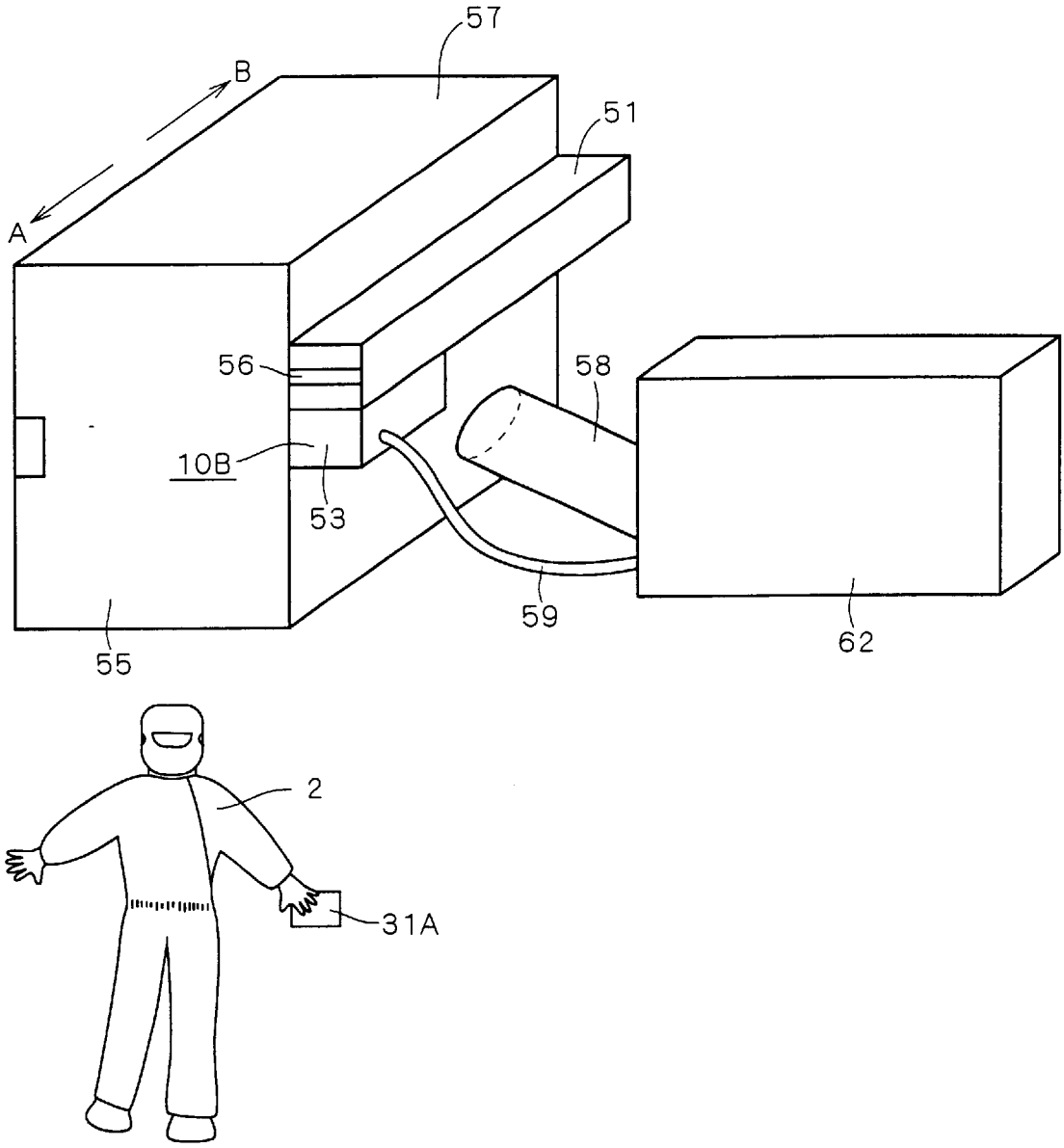
FIG. 5 is a schematic diagram depicting a clean garment managing system in accordance with a first modification of the first preferred embodiment.

FIG. 5 shows a second specific example of the clean garment managing system 10, as a clean garment managing system 10B. As shown in FIG. 5, the clean garment managing system 10B employs an impurity measuring instrument 62 such as gas chromatography, which serves as a measuring part 12, in place of the dust counter 52 (see FIG.

2). Here, the term "impurity" is understood to mean a material that is measurable as gas phase. The same parts as in the components previously described have similar reference numerals for reference to their description. This is true for the following description.

Figure 6:
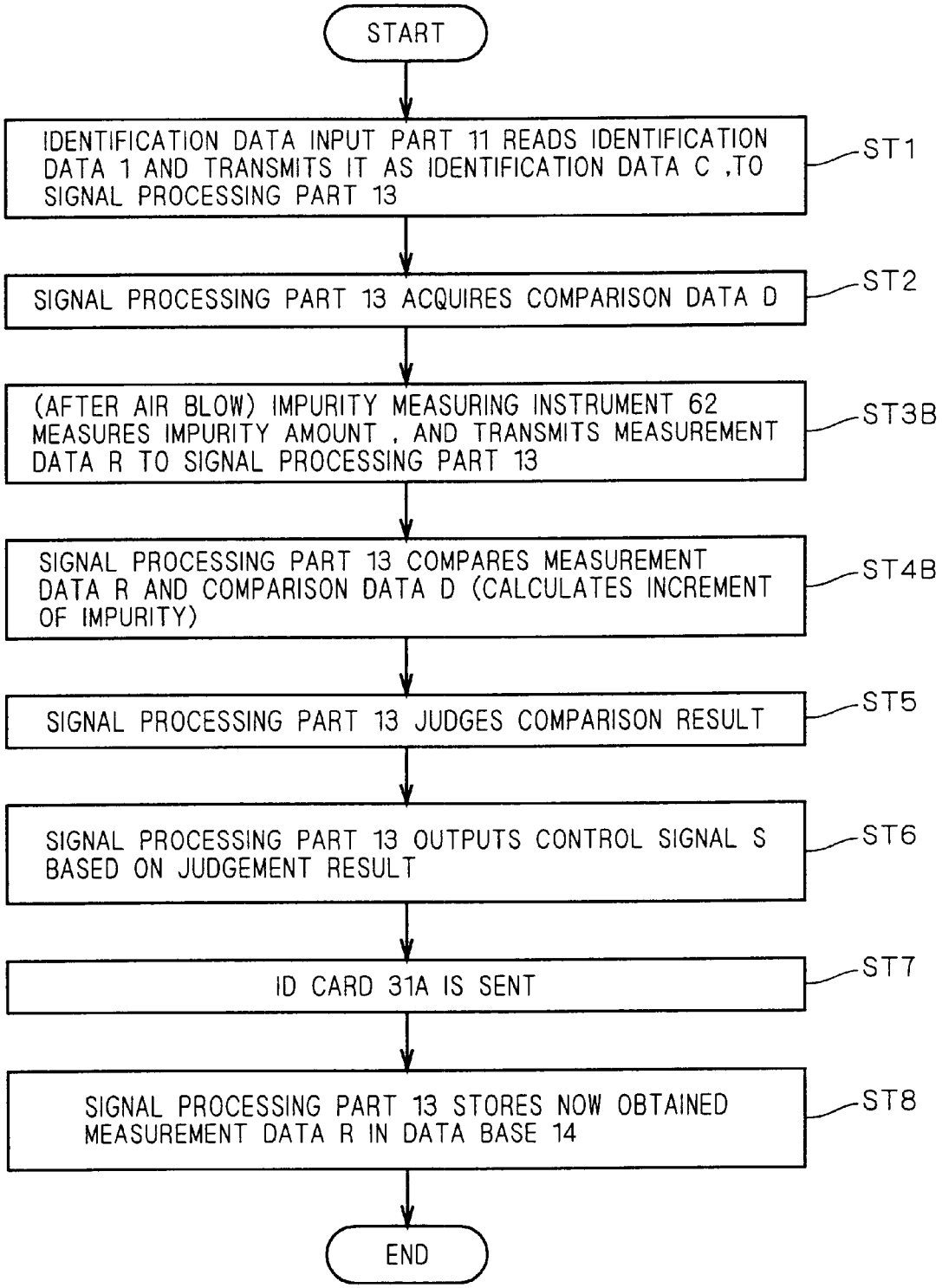
FIG. 6 is a flowchart illustrating operation of the clean garment managing system of FIG. 5.

Referring to the flowchart of FIG. 6, in the clean garment managing system 10B, at step ST3B corresponding to the above-mentioned step ST3 (see FIG. 3), the impurity measuring instrument 62 measures the amount of impurity in an air shower room 57 for a predetermined time after a waiting time of several seconds, for example, and the instrument 62 transmits the measured impurity amount to a signal processing part 13, as a measurement data R. The clean garment managing system 10B offers the same effect as the clean garment managing system 10A.

1.2 Second Modification of First Preferred Embodiment

Figure 7:
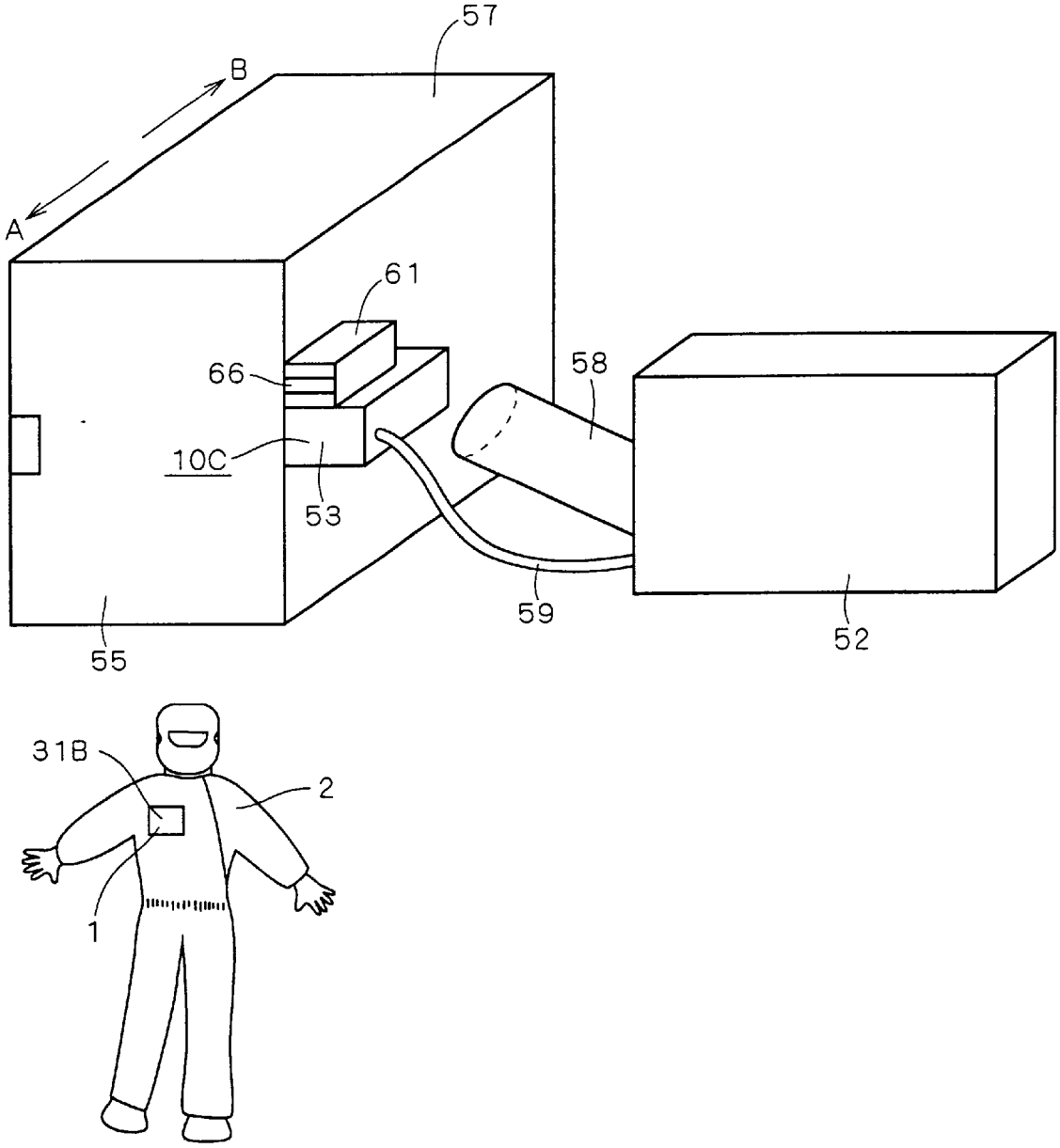
FIG. 7 is a schematic diagram depicting a clean garment managing system in accordance with a second modification of the first preferred embodiment.

In place of the ID card 31A (see FIG. 2), an identification data 1 may be applied to a clean garment directly or by means of recording the identification data 1 on a variety of materials. At this time, the identification data 1 is recorded in a clean garment 2, as in the case with the ID card 31A. For this, a device that can read directly the identification data 1 without separating it from the clean garment 2, is employed as an identification data input part 11. FIG. 7 shows a clean garment managing system 10C which is a third specific example of the clean garment managing system 10. As shown in FIG. 7, when used a clean garment 2 on which an identification data 1 is printed as a bar code 31B (details of the bar code is not illustrated), a bar code reader 61 having a bar code reading part 66 is employed as an identification data input part 11. With this construction, it is possible to make certain the association between the clean garment 2 and identification data 1. It is also possible to save the trouble of carrying and managing the ID card 31A.

Figure 3:
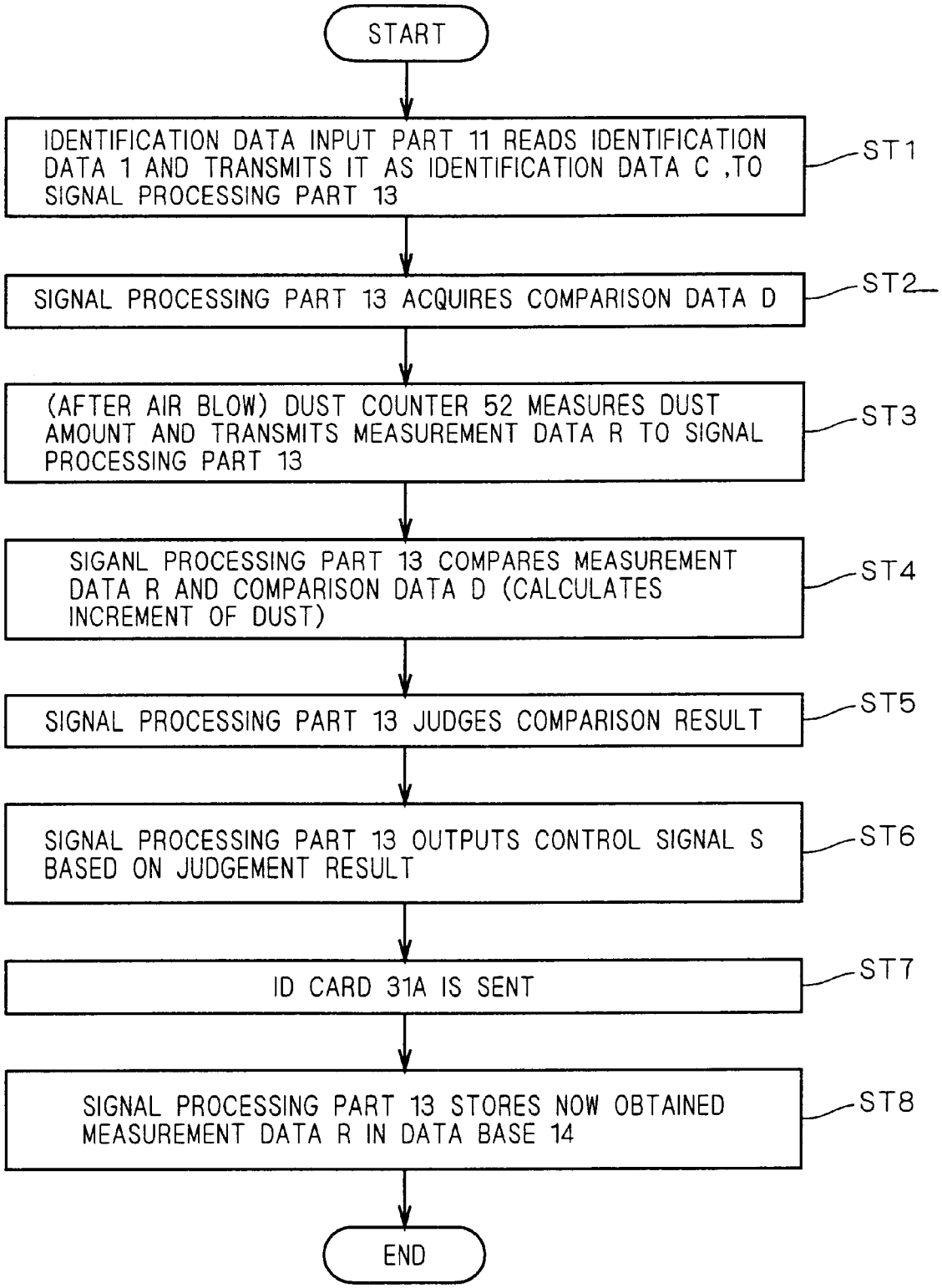
FIG. 3 is a flowchart illustrating operation of the clean garment managing system of FIG. 2.
Figure 4:
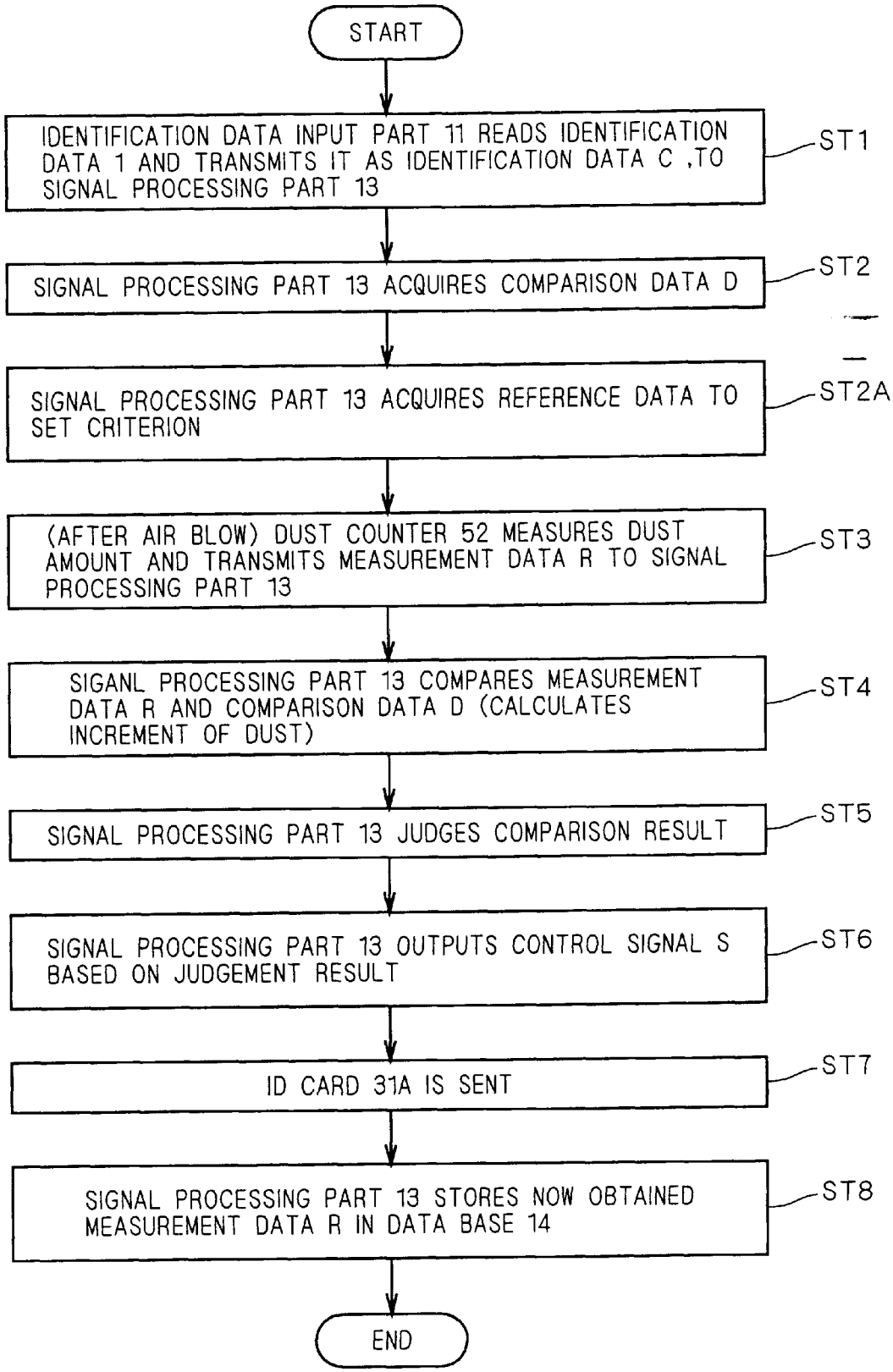
FIG. 4 is a flowchart illustrating another operation of the clean garment managing system of FIG. 2.
Figure 8:
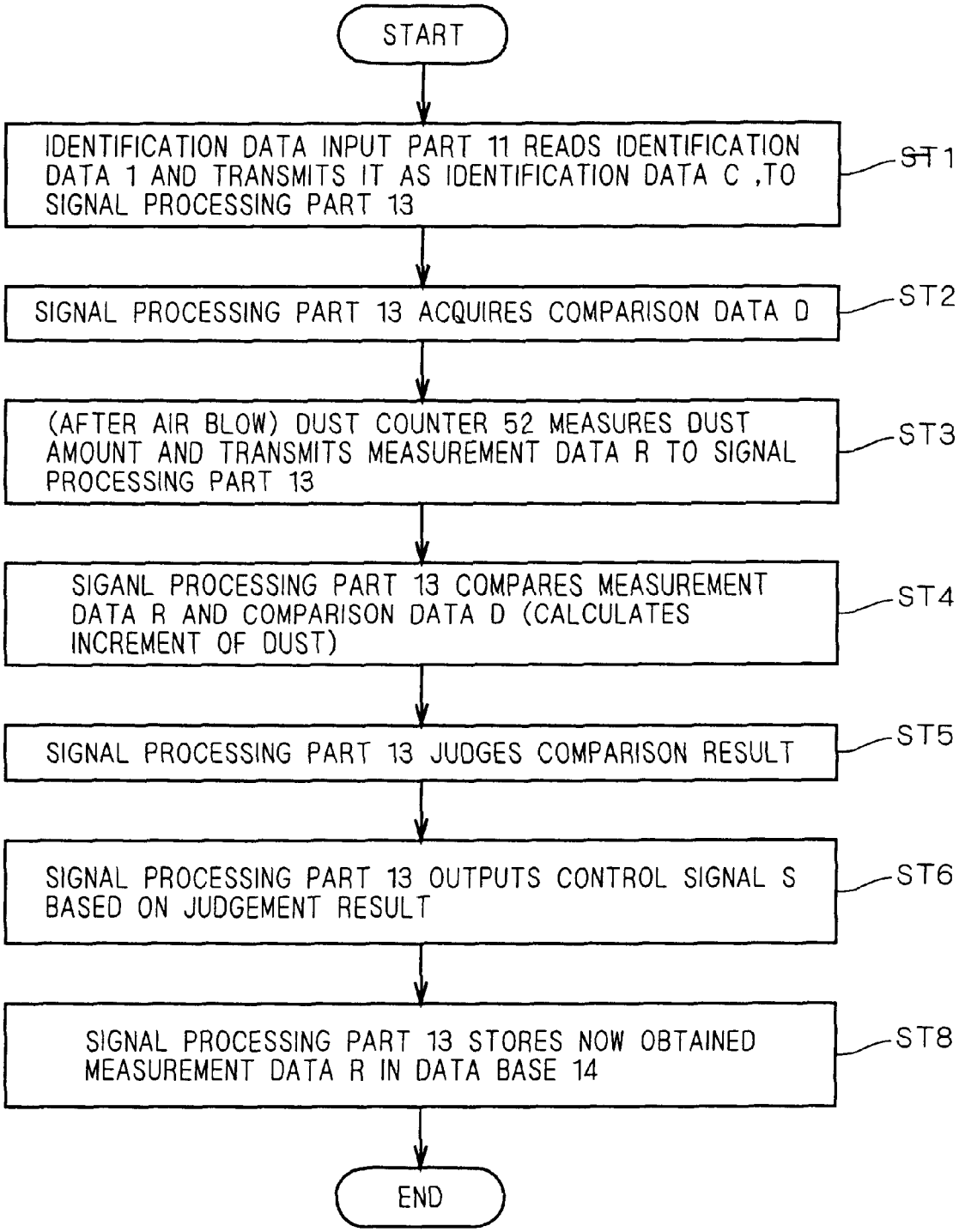
FIG. 8 is a flowchart illustrating operation of the clean garment managing system of FIG. 7.

Referring to the flowchart of FIG. 8, operation of the clean garment managing system 10C is the same as that of the clean garment managing system 10A shown in the flowchart of FIG. 3, except that the ID card transfer step ST7 is unnecessary (The door lock mechanism of the air shower room 57 is controlled under a control signal S, by the control part of the air shower room 57).

1.3 Third Modification of First Preferred Embodiment

Figure 9:
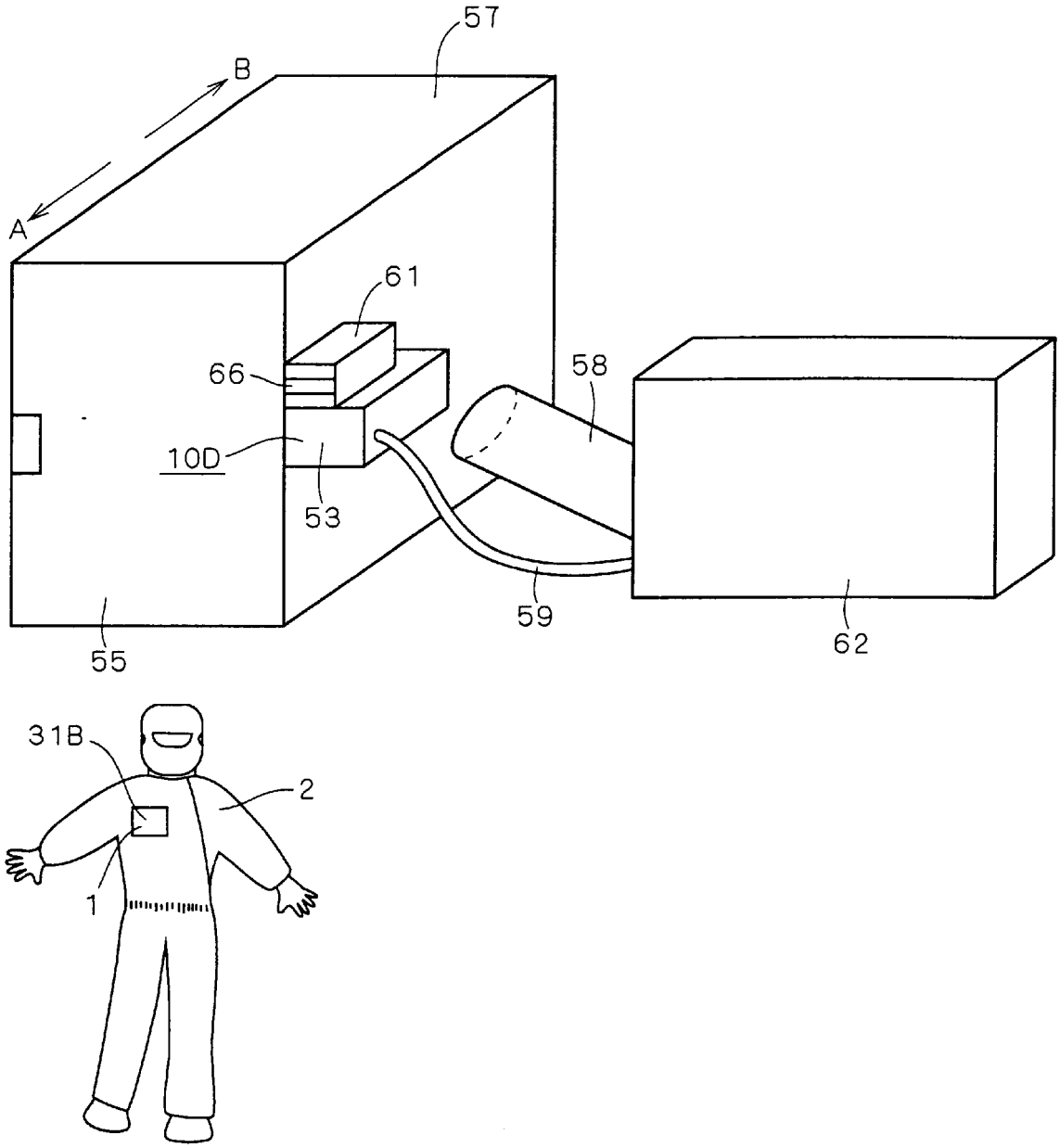
FIG. 9 is a schematic diagram depicting a clean garment managing system in accordance with a third modification of the first preferred embodiment.
Figure 10:
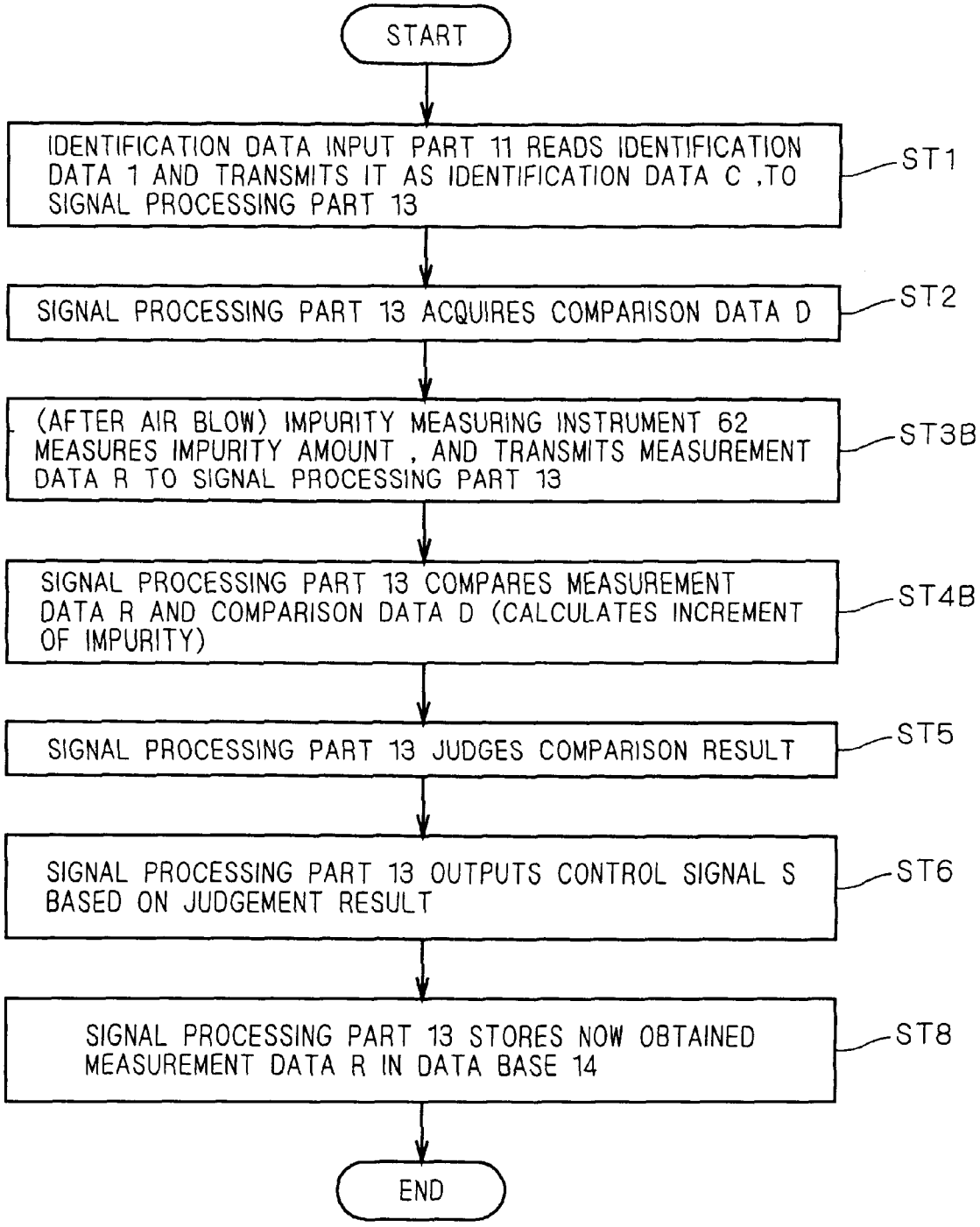
FIG. 10 is a flowchart illustrating operation of the clean garment managing system of FIG. 9.

FIG. 9 shows a clean garment managing system 10D which is a fourth specific example of the clean garment managing system 10. As shown in FIG. 9, the impurity measuring instrument 62 previously described may be employed as the measuring part 12 (see FIG. 1), in place of the dust counter 52 of the clean garment managing system 10C. Since every processing step as stated earlier is applicable to operation of the managing system 10D, it will be only given in the flowchart of FIG. 10.

Note that the identification data input part 11 such as the card recorder 51 or bar code reader 61 may be disposed within the air shower room 57.

2. Second Preferred Embodiment

The first preferred embodiment describes the construction that the amount of dust or impurity adherent to a clean garment 2 is measured by the dust counter 52 or impurity measuring instrument 62 which is the measuring part 12. A second preferred embodiment will describe the construction of a clean garment managing system with which the cleanliness of a clean garment 2 (that is correlated to the amount of dust or impurity) can be managed based on the discoloration of the clean garment 2.

Figure 11:
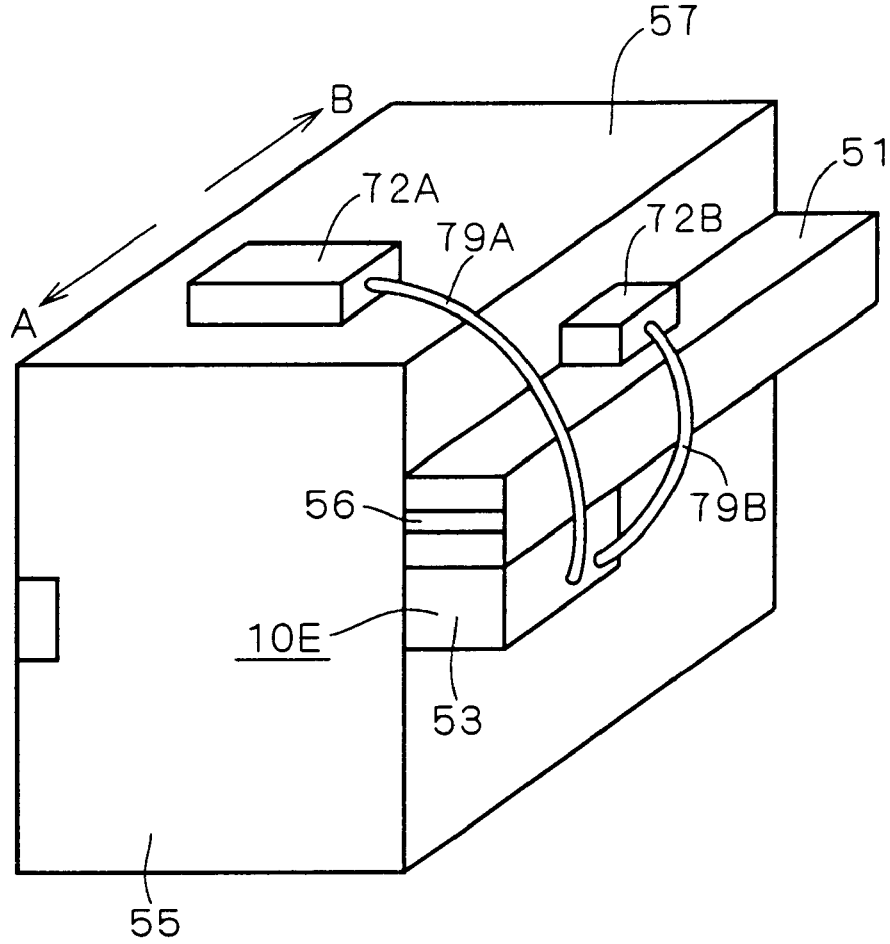
FIG. 11 is a schematic diagram depicting a clean garment managing system in accordance with a second preferred embodiment.
Figure 11:
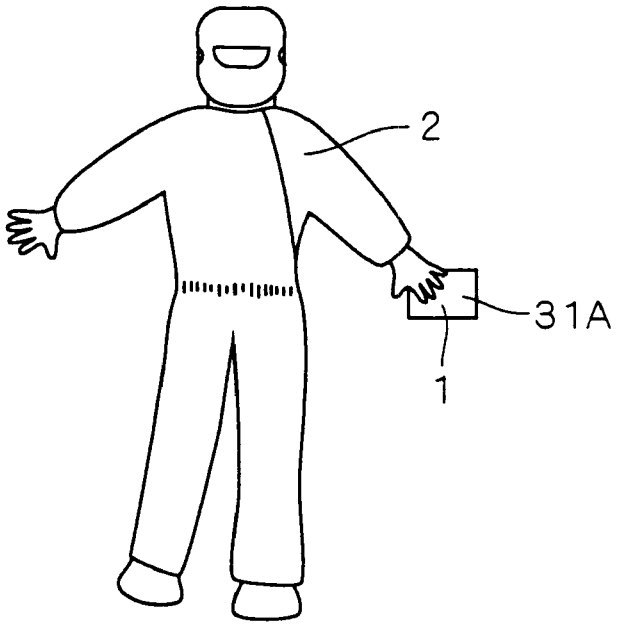

FIG. 11 shows a clean garment managing system 10E which is a specific example constructed in accordance with the second preferred embodiment of the clean garment managing system 10. As shown in FIG. 11, the managing system 10E has the unit 53 and card reader 51 as described, and an image capturing device (a CCD camera is exemplified here) 72A and 72B, as the measuring part 12 (see FIG. 1), which are disposed such that both can capture the entire clean garment of the worker present in an air shower room 57. In the managing system 10E the overall image of a clean garment is captured by the CCD cameras 72A and 72B, and then used as a measurement data R of the cleanliness of the clean garment. That is, in the managing system 10E the cleanliness of the clean garment is acquired as an image data. The image captured by the CCD cameras 72A and 72B is transmitted to a signal processing part 13 disposed in the unit 53, via data transfer cables 79A and 79B.

The number of the CCD cameras may be one or not less than three. As the image capturing device, other cameras than a CCD camera may be employed insofar as they can output the captured image in a data format (digital image) that is processible in the signal processing part 13 (see FIG. 1). For example, an image may be captured by a camera, and the obtained image is digitized and then outputted to the signal processing part 13. In this case, the camera and components performing digital image processing corresponds to "the image capturing-device."

In a data base 14 (see FIG. 1) of the second preferred embodiment, image data of each clean garment 2 in a clean state (e.g., a state immediately after cleaning) as a comparison data D, is stored in association with an identification data C.

Figure 12:
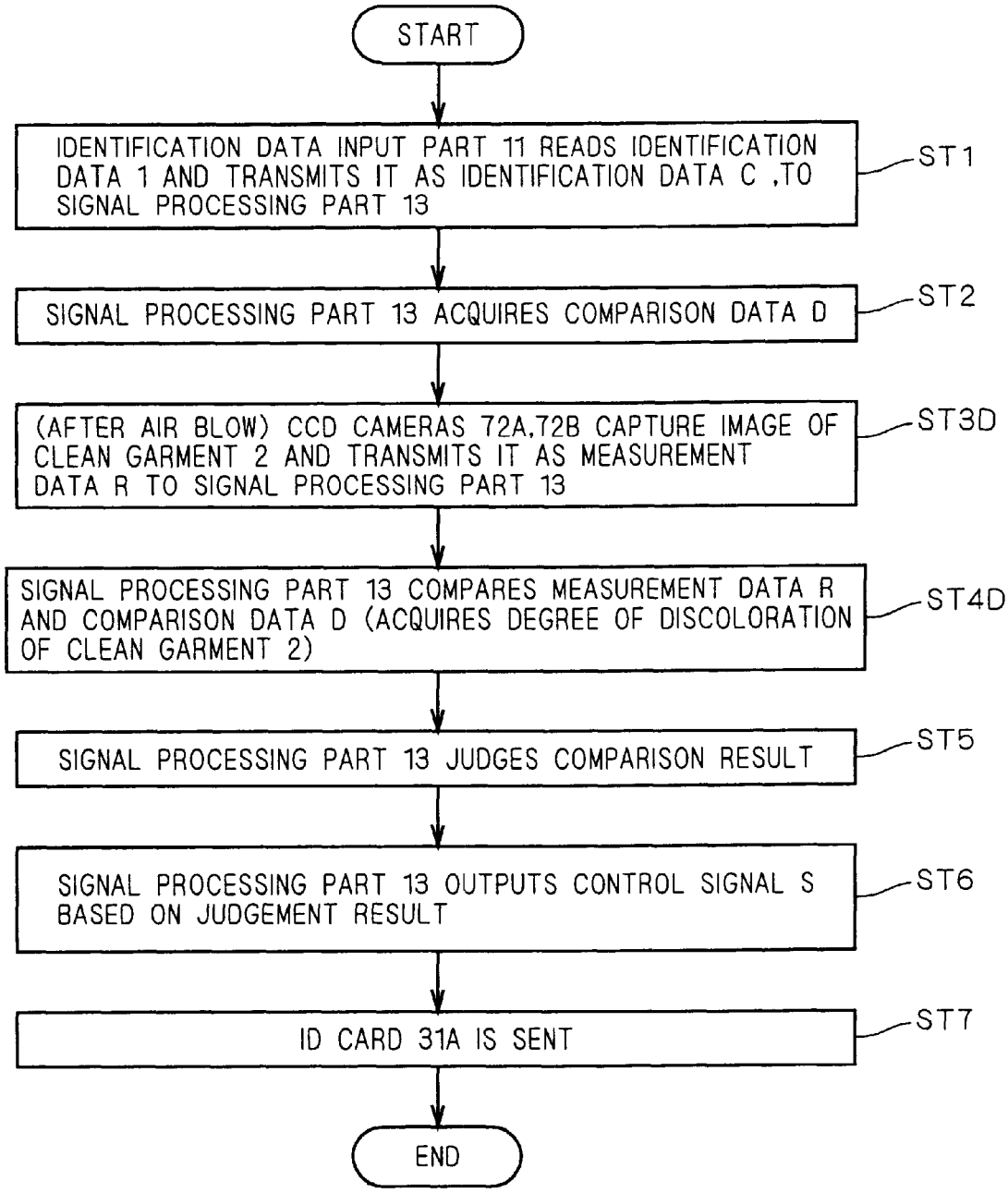
FIG. 12 is a flowchart illustrating operation of the clean garment managing system of FIG. 11.

Operation of the clean garment managing system 10E will be described by referring to the flowchart of FIG. 12. Firstly, when the worker inserts an ID card 31A into a card insertion slot 56, the managing system 10E executes steps ST1 and ST2 stated earlier. At step ST2, a signal processing part 13 reads, as a comparison data D, the image data of such a clean state which is associated with the received identification data C, from a data base 14 (see FIG. 1).

At the moment the worker enters an air shower room, air blow is performed. After a waiting time has elapsed on completion of the air blow, CCD cameras 72A and 72B capture the entire image of a clean garment and transmits the captured image to the signal processing part 13, as a measurement data R (step ST3D).

The image processing part 13 makes an image comparison between the received measurement data R and the read comparison data D, to obtain a degree of discoloration of the clean garment (step ST4D). For example, the difference of density is obtained by comparing the image density of the image data R and that of the image data D. The degree of discoloration that is the result of the comparison processing may be obtained as a numerical data or image data.

Then, the signal processing part 13 judges whether the degree of discoloration is in the range of a predetermined criterion (step ST5) and, based on the result of the judgement, outputs a predetermined control signal S to a variety of control objects 21 described below (step ST6). The following processing and operation of the clean garment managing system 10E is the same as in those in step ST7 stated earlier.

Thus, with the clean garment managing system 10E, the measurement data R of the cleanliness of a predetermined clean garment 2 and the comparison data D are associated with each other via the identification data C, as in the foregoing managing systems. Therefore, the comparison processing step ST4 is executable per clean garment, and the cleanliness of the clean garment 2 can be managed per clean garment.

Unlike a measurement data R (the amount of dust or impurity) in the foregoing managing system 10A and so on, the clean garment managing system 10E employs the entire image data of a clean garment as a measurement data R. Hence, the measurement data R contains information about the size of the clean garment, thereby managing cleanliness per clean garment, taking its size into consideration. Further, when the criterion set per clean garment is used together with the reference data as described, it is able to perform a further detailed clean garment management per clean garment.

In addition, by storing at least the previous measurement data (image data) R in a data base, a comparison between the now obtained measurement data R and the previous measurement data R may be made as in the clean garment managing system 10A and the like. In this case, there is provided step ST7 shown in FIG. 3, namely, a processing step in which the now obtained measurement data R is associated with an identification data C and then stored in the data base 14.

2.1 First Modification of Second Preferred Embodiment

Figure 13:
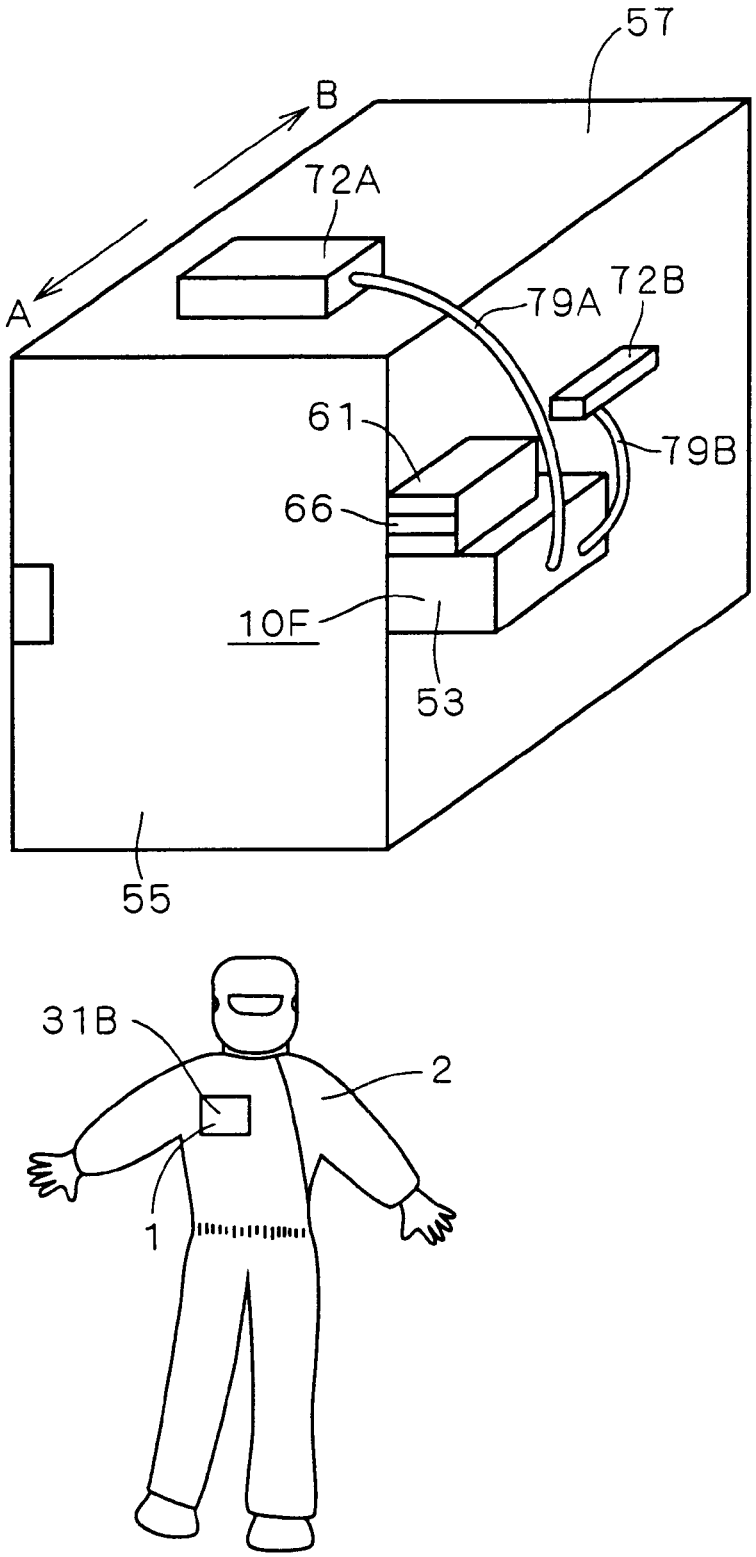
FIG. 13 is a schematic diagram depicting a clean garment managing system in accordance with the second preferred embodiment.
Figure 14:
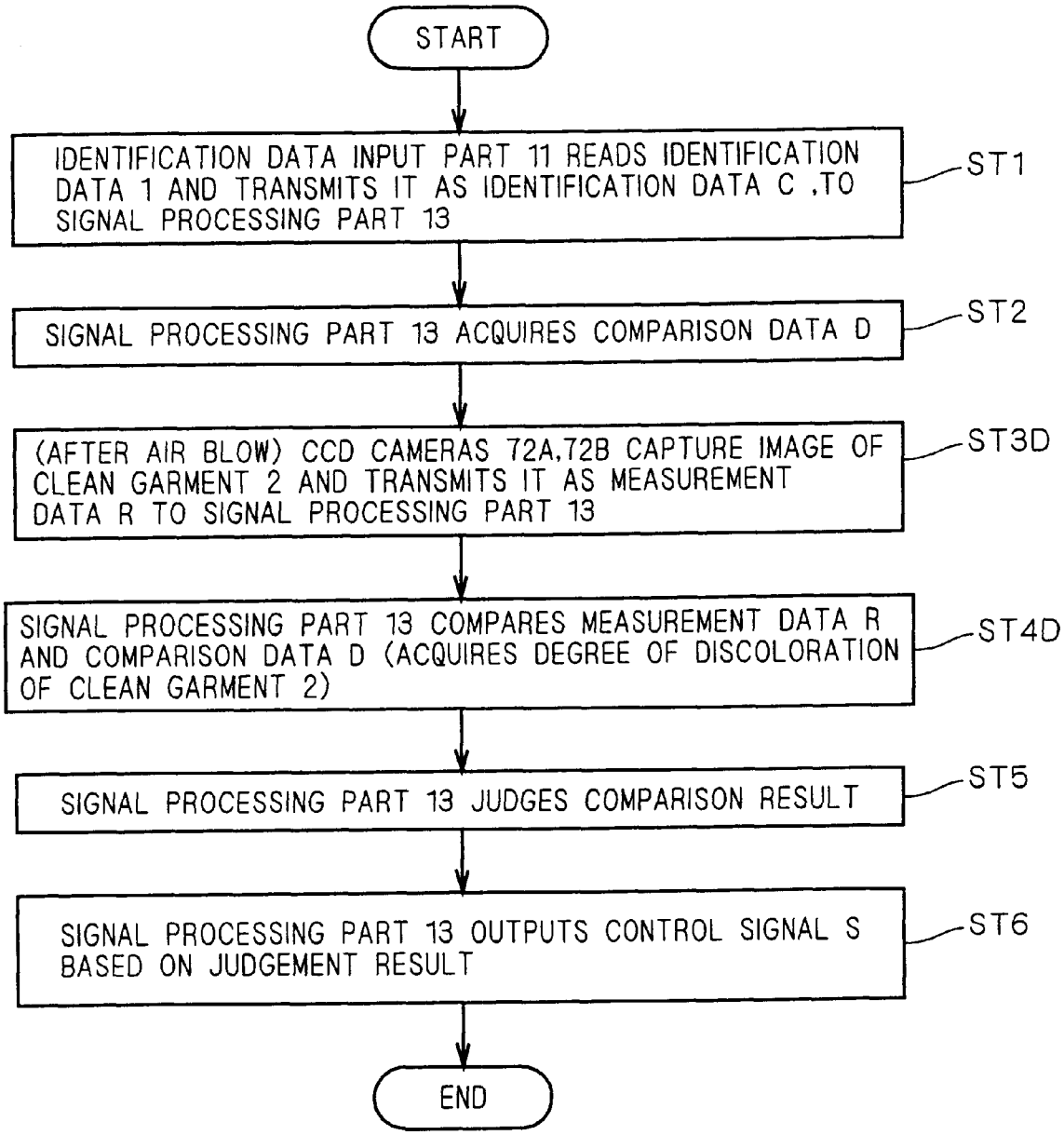
FIG. 14 is a flowchart illustrating operation of the clean garment managing system of FIG. 13.

FIG. 13 shows a clean garment managing system 10F in accordance with a second specific example of the second preferred embodiment. When a clean garment 2 having an identification data 1 in the form of a bar code 31, for example, is used instead of the ID card 31A (see FIG. 11), a bar code reader 61 is employed as shown in FIG. 13. In this case, image capturing devices 72A and 72B may be utilized as an identification data input part 11 of the bar code reader 61 or the like. Since every processing step previously described is applicable to operation of the clean garment managing system 10F, it will be only shown by the flowchart of FIG. 14.

Note that the identification data input part 11 such as the card recorder 51 and the bar code reader 61 may be disposed within an air shower room 57.

Another clean garment managing system may be constructed in various combinations of the measuring parts of the foregoing clean garment managing systems. This permits a multi-aspect measurement of a reduction in the cleanliness of clean garments. As the identification data input part 11, an input device such as a keyboard may be employed such that the workers input their own identification data 1 (or identification data C). Further, the cleanliness of the clean garment 2 may be measured when the worker leaves a clean room. If the cleanliness of the clean garment 2 is measured when the worker enters and leaves the clean room, a reduction in the cleanliness of the clean garment 2 during the work time can be detected.

3. Third Preferred Embodiment

Figure 15:
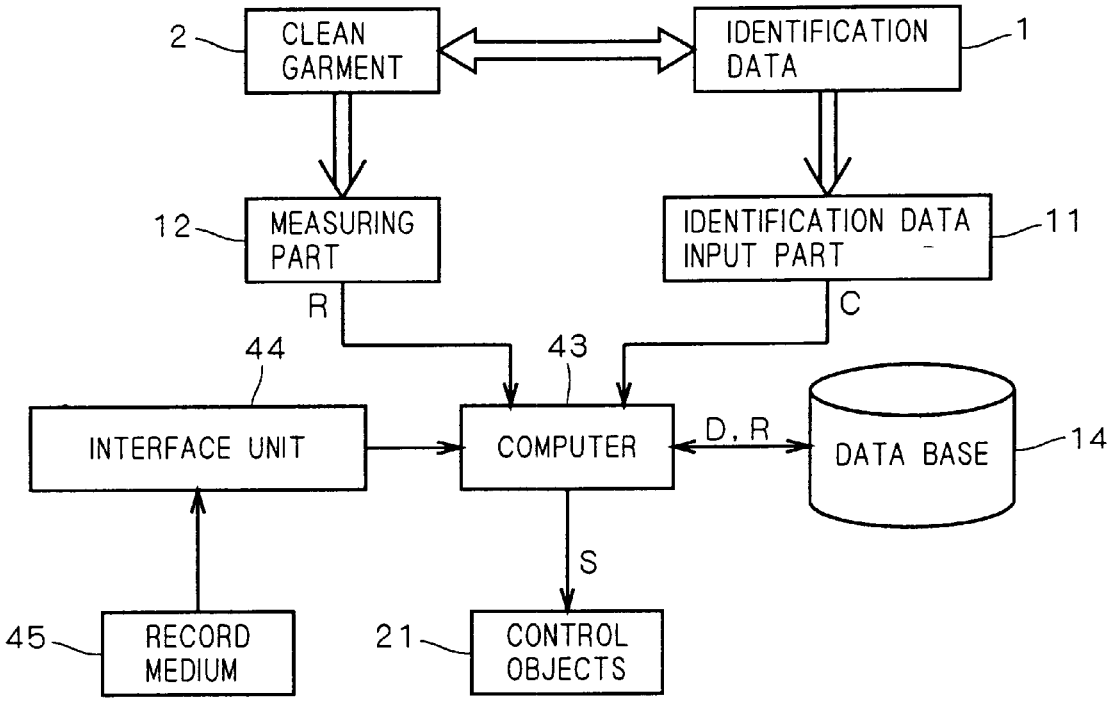
FIG. 15 is a schematic diagram depicting a clean garment managing system in accordance with a third preferred embodiment.
Figure 16:
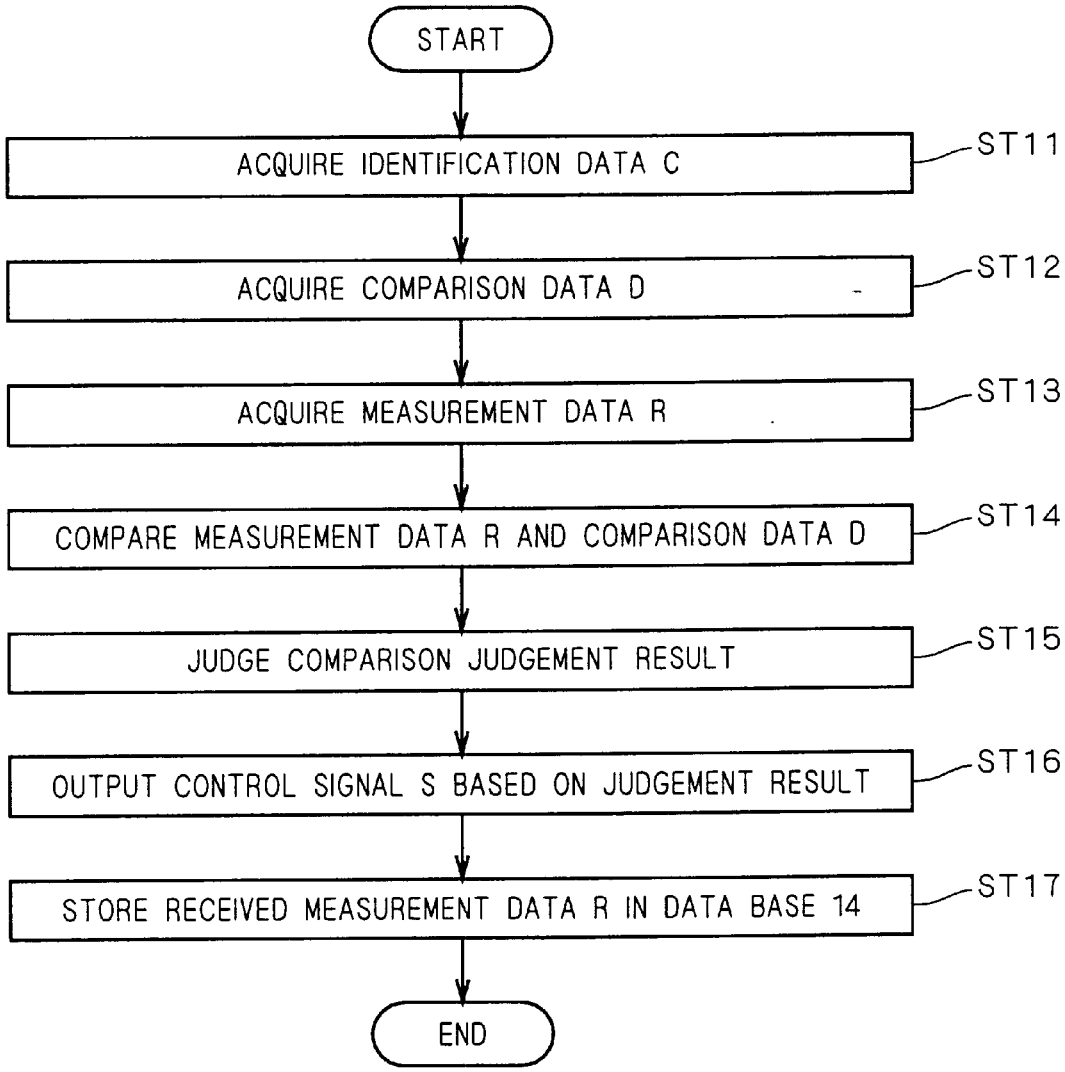
FIG. 16 is a flowchart illustrating the contents processed on a computer in the clean garment managing system of FIG. 15.

It is possible that a program of signal processing used in the signal processing part 13 of the foregoing clean garment managing systems is stored in a storage part (e.g., a memory) of a computer, and the program is executed on the computer. The program may be stored in advance in the storage part. Alternatively, as shown in FIG. 15, the program may be recorded in a computer readable record medium (e.g., a flexible disk or CD-ROM) 45, and a computer 43 reads and executes the program via an interface unit 44. Taking, as an example, a program corresponding to the processing contents executed by the signal processing part 13 of the clean garment managing system 10A shown in FIG. 2, the program executed by the computer 43 will be described by referring to the flowchart of FIG. 16. The flowchart of FIG. 16 corresponds to that in FIG. 3.

Firstly, a computer 43 receives and acquires an identification data C from an identification data input part 11 (card reader 51) (step ST11). The computer 43 then acquires, by referencing to a data base 14, a comparison data D (the previous measurement data R herein) which is associated with the identification data C (step ST12). The computer 43 also receives and acquires a measurement data R from a measuring part 12 (dust counter 52) (step ST3). Note that steps ST12 and ST13 may be in the reverse order. Thereafter, the computer 43 performs the same comparison processing as in step ST4 stated earlier (see FIG. 3), based on the measurement data R and comparison data D thus acquired (step ST14). The same judgement processing as in step ST5 stated earlier (see FIG. 3) is performed on the comparison result (step ST15), to output a control signal S (step ST16). Then, the measurement data R acquired at step ST13 is stored in the data base 14 (step ST17). Note that step ST16 may be performed at any point of time after acquiring the measurement data R.

As stated above, with the construction shown in FIG. 15, the same effect as in the clean garment managing system 10A can be obtained. A similar construction is, of course, applicable to a program about the signal processing in the signal processing part 13 of the managing systems other than the managing system 10A.

While the invention has been shown and described in detail, the foregoing description is in all aspects illustrative and not restrictive. It is therefore understood that numerous modifications and variations can be devised without departing from the scope of the invention.

What is claimed is:

1. A clean garment managing system comprising:

an identification data input part that acquires and outputs an identification data identifying a predetermined clean garment;

a measuring part that measures a cleanliness of said predetermined clean garment and outputs a measurement data about a measurement result;

a data base in which at least a comparison data about said cleanliness of said clean garment is stored in association with said identification data; and a signal processing part that receives said identification data and said measurement data and performs a comparison processing in which a comparison is made between said comparison data in association with said identification data received and said measurement data received.

2. A clean garment managing system according to claim 1, wherein said comparison data is said measurement data.

3. A clean garment managing system according to claim 2, wherein data about an order in which said measurement data is obtained is stored in association with said measurement data in said data base.

4. A clean garment managing system according to claim 1, wherein said comparison processing is a processing in which a comparison is made between said comparison data in association with said identification data received and said measurement data received, to calculate a difference therebetween.

5. A clean garment managing system according to claim 1, wherein said measurement part is at least one of a dust counter for measuring the amount of dust in air and an impurity measuring instrument for measuring the concentration of impurity in air.

6. A clean garment managing system according to claim 1, wherein said measurement part includes an image capturing device;

said measurement data and comparison data include an image data; and said signal processing part performs said comparison processing by image comparison processing.

7. A clean garment managing system according to claim 1, wherein said measurement part includes an image capturing device;

said measurement data includes an entire image data of said predetermined clean garment captured by said image capturing device;

said comparison data includes an image data about a clean state of said predetermined clean garment in association with said identification data; and said signal processing part performs said comparison processing by image comparison processing.

8. A clean garment managing system according to claim 1, wherein said image processing part further performs judgment processing in which of said predetermined clean garment is judged according to a criterion common to clean garments, based on a result of said comparison processing.

9. A clean garment managing system according to claim 1, wherein said data base further stores a reference data in association with said identification data; and said signal processing part further references to said data base to set a criterion based on said reference data in association with said received identification data, to judge said cleanliness of said predetermined clean garment according to said set criterion.

10. A clean garment managing system according to claim 1, wherein said identification data is recorded in an ID card carried by a worker wiring said predetermined clean garment.

11. A clean garment managing system according to claim 1, wherein said identification data is recorded on said clean garment.

12. An air shower room comprising a clean garment managing system according to claim 1.

13. A computer readable record medium recording a program which is used in computer management of a cleanliness of clean garments by employing an identification data input part that acquires and outputs an identification data identifying a predetermined clean garment, a measuring part that measures said cleanliness of said clean garment and outputs a measurement data about its measurement result, and a data base in which at least a comparison data of said cleanliness of said clean garment is stored in association with said identification data, characterized in that:

said record medium records said program with which said computer executes the steps of:

(a) acquiring said identification data from said identification data input part;

(b) acquiring said measurement data from said measuring part; and (c) referencing said data base for making a comparison between said comparison data in association with said identification data acquired and said measurement data acquired.

* * * * *